US010669138B2

(12) United States Patent
Baugh

(10) Patent No.: US 10,669,138 B2
(45) Date of Patent: Jun. 2, 2020

(54) METHOD OF PROVIDING PRELOAD FOR A DUAL DRUM TRACTION WINCH

(71) Applicant: Benton Frederick Baugh, Houston, TX (US)

(72) Inventor: Benton Frederick Baugh, Houston, TX (US)

( * ) Notice: Subject to any disclaimer, the term of this patent is extended or adjusted under 35 U.S.C. 154(b) by 121 days.

(21) Appl. No.: 15/889,595

(22) Filed: Feb. 6, 2018

(65) Prior Publication Data

US 2019/0241411 A1 Aug. 8, 2019

(51) Int. Cl.
*B66D 1/74* (2006.01)

(52) U.S. Cl.
CPC .... *B66D 1/7405* (2013.01); *B66D 2700/0108* (2013.01)

(58) Field of Classification Search
CPC .. B66D 1/7405; B66D 1/7421; B66D 1/7442; B66D 1/26; B66D 1/36; B66D 1/38; B66D 1/50; B66D 2700/0108
See application file for complete search history.

(56) References Cited

U.S. PATENT DOCUMENTS 344,554 A * 6/1886 Weygant ..... 137/355.2
1,659,160 A * 2/1928 Richards ..... B65H 75/4407 191/12.2 R
1,782,358 A * 11/1930 Lang ..... B66D 1/36 242/483
2,926,867 A * 3/1960 Nardone ..... B66D 1/36 242/397.3
3,048,370 A * 8/1962 Kratzer ..... B66D 1/36 254/333
3,836,123 A * 9/1974 Bausenbach ..... B66D 1/28 242/157.1
4,516,795 A 5/1985 Baugh
4,953,829 A * 9/1990 Knaack ..... B66D 1/34 242/586.2
6,089,547 A * 7/2000 Juelich ..... B66D 1/741 114/230.23
6,435,447 B1 * 8/2002 Coats ..... E21B 19/22 242/483
8,720,811 B2 * 5/2014 Zink ..... B65H 75/38 242/397
9,181,069 B2 * 11/2015 I-Te ..... B66D 1/38
9,567,195 B2 * 2/2017 Hall ..... B66C 13/46
10,336,590 B2 * 7/2019 Hall ..... B66D 1/30
2010/0314594 A1 * 12/2010 Seow ..... B66D 1/7447 254/333
2011/0278520 A1 * 11/2011 Ingeberg ..... B63B 21/04 254/281
2013/0170939 A1 * 7/2013 Roodenburg ..... B66D 1/7405 414/800
2013/0341453 A1 * 12/2013 Sandvik ..... B66D 1/7415 242/419.7
2014/0091268 A1 * 4/2014 Heravi ..... B66D 1/505 254/274

(Continued)

*Primary Examiner* — Emmanuel M Marcelo

(57) ABSTRACT

The method of providing a necessary preload for a rope or cable on a dual drum traction winch without reducing the capacity of the winch or requiring a second piece of capital equipment to provide the preload force by using a freely rotating wheel to load the rope or cable against at least one of the drums and cause a frictional traction on the winch drum.

11 Claims, 7 Drawing Sheets

(56) References Cited

U.S. PATENT DOCUMENTS

| | | | | |
|---|---|---|---|---|
| 2014/0199152 | A1* | 7/2014 | Roodenburg | B66D 1/7405 414/800 |
| 2014/0284531 | A1* | 9/2014 | Hoyt | B66D 1/38 254/385 |
| 2015/0375975 | A1* | 12/2015 | Flateland | B66D 1/7405 254/310 |
| 2016/0031685 | A1* | 2/2016 | Lawson | B66D 1/30 414/800 |

* cited by examiner

METHOD OF PROVIDING PRELOAD FOR A DUAL DRUM TRACTION WINCH

TECHNICAL FIELD

This invention relates to the method providing a necessary preload for a dual drum traction rope winch without reducing the capacity of the winch or requiring a second piece of capital equipment to provide the preload force.

BACKGROUND OF THE INVENTION

Equipment packages are often placed on the ocean floor, at the surface or within pipelines by using on a cable. The cable can be of steel construction or synthetic materials with different advantages for each. Synthetic rope is the newer technology and offers features such as near neutral buoyancy in water and ease of terminations. A disadvantage of the synthetic ropes is that if wound layer over layer on a conventional drum like the steel cables, the outer layers will "knife" into the lower layers and tend to destroy the cable.

For this reason, the storage and low load pre-tensioning of the synthetic rope is handled by a first winch or reel and a second dual drum winch specific to handling synthetic rope handles the higher load. These special dual drum winches are typically dual drum traction winches. The traction name is because they use multiple wraps around multi-groove drums to accumulate a lot of friction or traction. Literally the friction from one drum groove is passed on to and is amplified by the next drum groove it crosses. Enough drum grooves are provided to amplify the initial tension up to a working level. They require an initial tension or pre-tension to work at all or the cable just slips on the drums.

As the dual drum traction winches require a pretention to be held on the synthetic rope coming into these special winches, it means two different types of capital equipment must be delivered to the job to utilize the synthetic rope. A pretention reel and a high capacity dual drum traction winch are both required. This reasonably eliminates bringing the synthetic rope to the jobsite on a wooden spool and simply putting it on a support stand or dispensing the synthetic rope from a wooden box or directly off the deck or floor.

Another complication is that the pretension provided by another reel is somewhat unpredictable. On the outer wraps at the larger diameters the motor or brake providing the back tension or pretension will give a certain value. At the inner wraps when the radius to the cable or rope is reduced, the back tension or pretension value goes inversely proportionate to the radius unless special care is taken. Adding to this the actual tension in the line between the pretension device and the dual drum traction winch is usually difficult to know. The load on the dual drum traction winch will be known as you are picking up a specific weight. Between the back tension or pretension device and the dual drum traction winch, you have no convenient measure like this. This means that in some cases a significant percentage of the dual drum traction winch capacity can be reduced by the amount of the hard to predict pretension loading.

This problem has persisted as long as cable or rope has been handled by the dual drum traction winches, with all the extra costs and complications which are inherent in providing duplicate pieces of capital equipment to do a single job.

BRIEF SUMMARY OF THE INVENTION

The object of this invention is to provide a method of causing the dual drum traction winch to generate its own preload without having to depend upon the preload of an upstream winch.

A second object of this invention is to cause the dual drum traction winch to initiate its pretention without causing a reduction in the force available from the winch.

A third object of this invention is to allow the dual drum traction winch to work with an upstream reel, upstream winch, an unpowered spool, a spool with no brake, or a loose bundle of rope.

Another objective of this invention is to cause the pretension generated within the dual drum traction winch to be adequate for all loads which the dual drum traction winch might be able to pull.

DETAILED DESCRIPTION OF THE INVENTION

Figure 1:
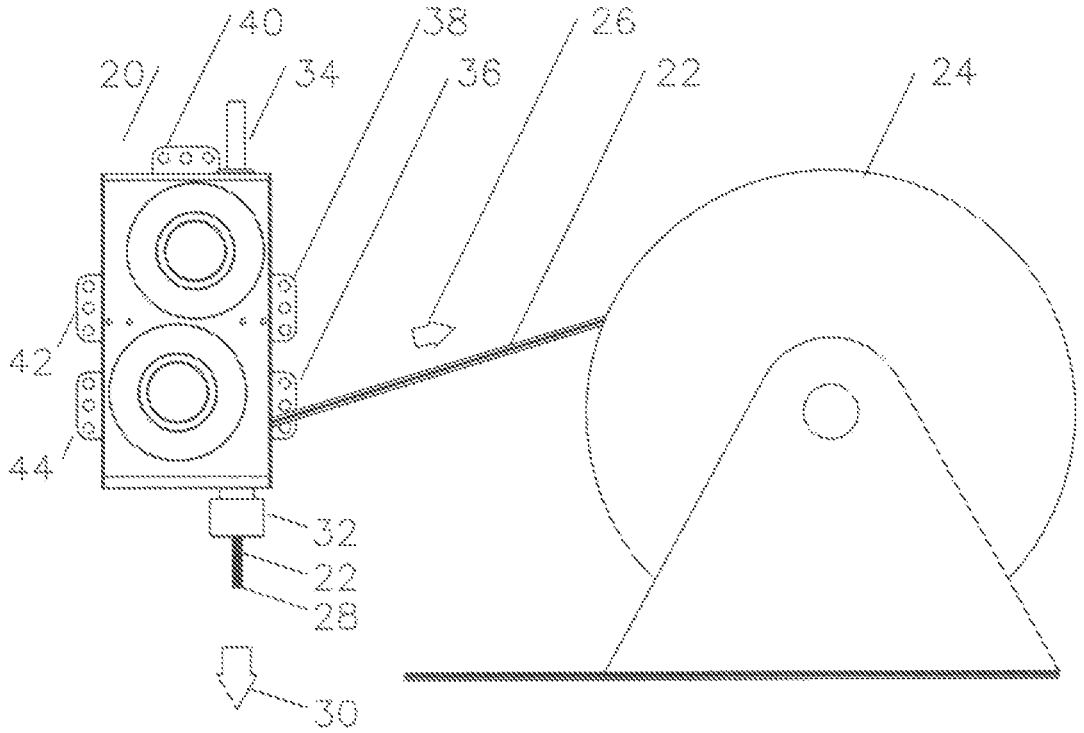
FIG. 1 is a view of a traction winch drawing cable from a powered spool.

Referring now to FIG. 1, a view of a dual drum traction winch 20 is shown with a synthetic rope 22 being pretensioned back to a reel 24 with a load illustrated by arrow 26. Synthetic rope 22 is seen exiting the dual drum traction winch 20 at 28 under a higher tension load to do useful work as indicated by arrow 30. Mounting 32 is illustrated for supporting the dual drum traction winch 22 and pivot post 34 is shown as available concentric to mounting 32 to support the end of the winch, when it is mounted in the horizontal position rather than the vertical position as is shown. This give freedom of orientation for the assistance to the operator as it is not required to keep tension between a storage reel and the dual drum traction winch. Various lifting pad eyes 36-44 are shown spaced around for handling the winch.

Figure 2:
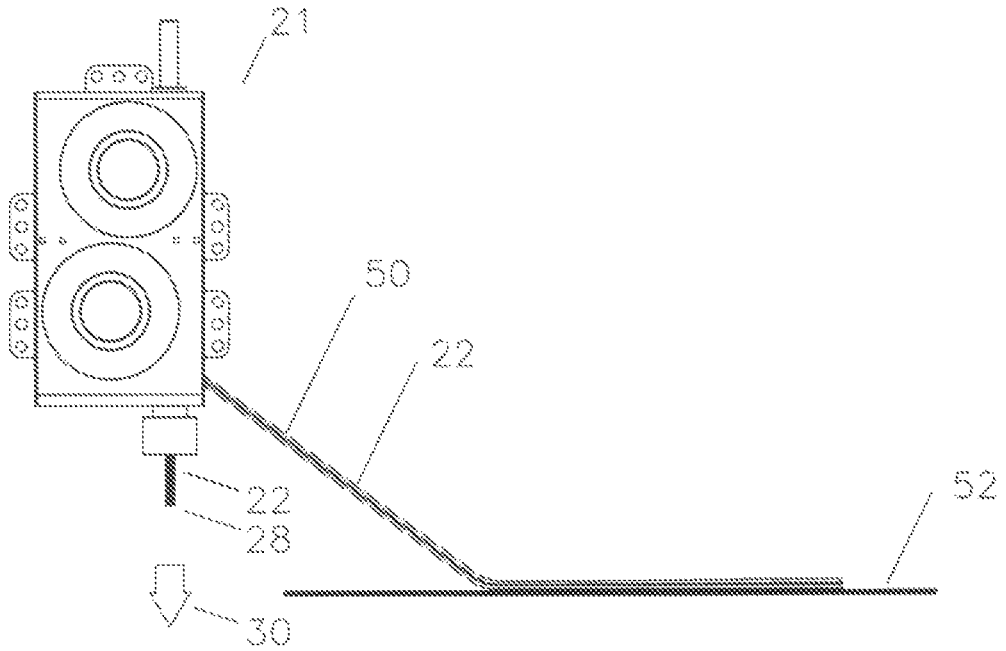
FIG. 2 is a view of a traction winch drawing cable simply off the deck, which can be illustrative of being on the deck or in a box.

Referring now to FIG. 2, a similar winch 21 using the capabilities of this invention is shown, with the synthetic rope 22 still having the same higher tension at 28. However, at 50 the synthetic rope 22 is shown to have no pretention but is simply laid along the deck or floor at 52.

Figure 3:
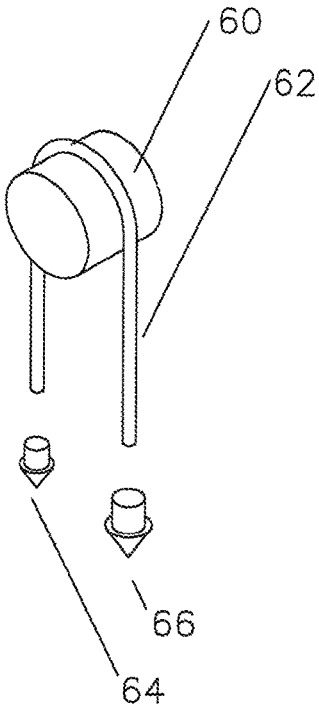
FIG. 3 is a perspective illustration of a rope being pulled over a bar showing that if a force is held on one end, it takes a higher force to pull down on the other end to overcome the first force and to overcome the sliding friction against the bar.

Referring now to FIG. 3, a stationary bar 60 is shown with a rope 62 draped over it. When a restraining force or weight 64 is held on the rope, a larger force 66 is required to pull the rope 62 against the restraining force or weight 64 due to friction between the rope 62 and the bar 60.

Figure 4:
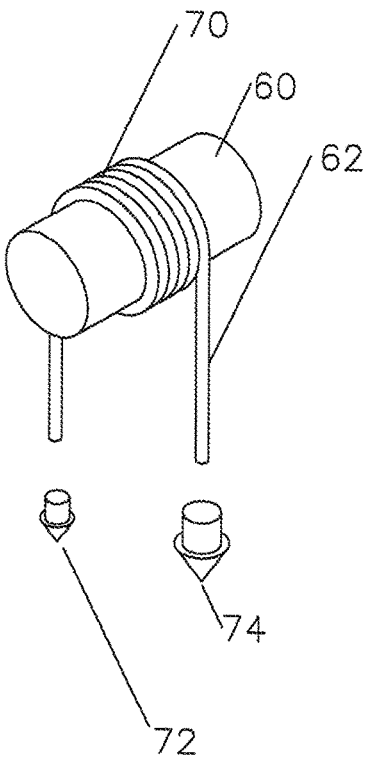
FIG. 4 is a perspective illustration of a rope being pulled over a bar with multiple wraps around the bar showing that if a force is held on one end, illustrating that at some point the force required to pull down on the second end of the rope may be higher than the available force.

Referring now to FIG. 4, when enough wraps 70 of the rope 60 are wound around the stationary bar 60, a reasonably small weight 72 can be applied to one end of the rope 60 and a very high load can be pulled at 74 which will cause the rope 62 to slip around the stationary bar 60. You can literally be supporting a very high load 74 and loosed the load 72 to near zero and the load as represented by the arrow 74 will slip and be lowered with very good control.

Figure 5:
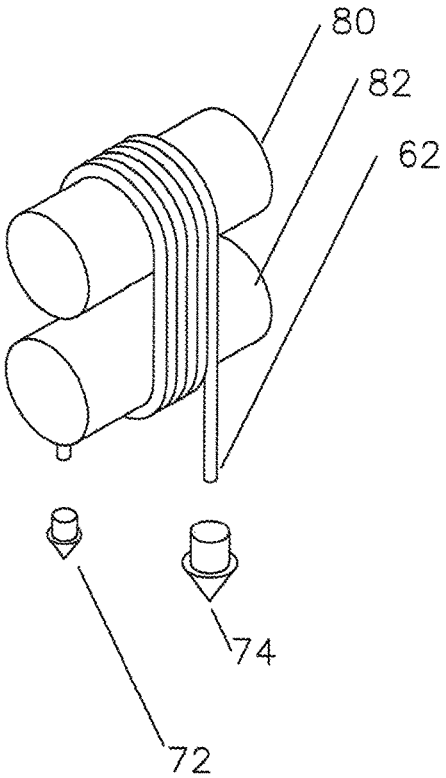
FIG. 5 is a perspective illustration of a rope being pulled over a pair of bars with multiple wraps around the pair of bars showing that if a force is held on one end, illustrating that at some point the force required to pull down on the second end of the rope may be higher than the available force, generally illustrating the concept of a traction winch.

Referring now to FIG. 5, consider that stationary bar 60 has now become two parallel bars 80 and 82 and rope 62 is wrapped around both of them. It operates exactly the same as in FIG. 4. Now, consider you rotate both the bars 80 and 82 at the same speed, and you have made a dual drum dual drum traction winch. There are some upgrades such as grooving the parallel bars 80 and 82 to control the position of the cable 60 and assigning the preload 72 to a separate device.

Figure 6:
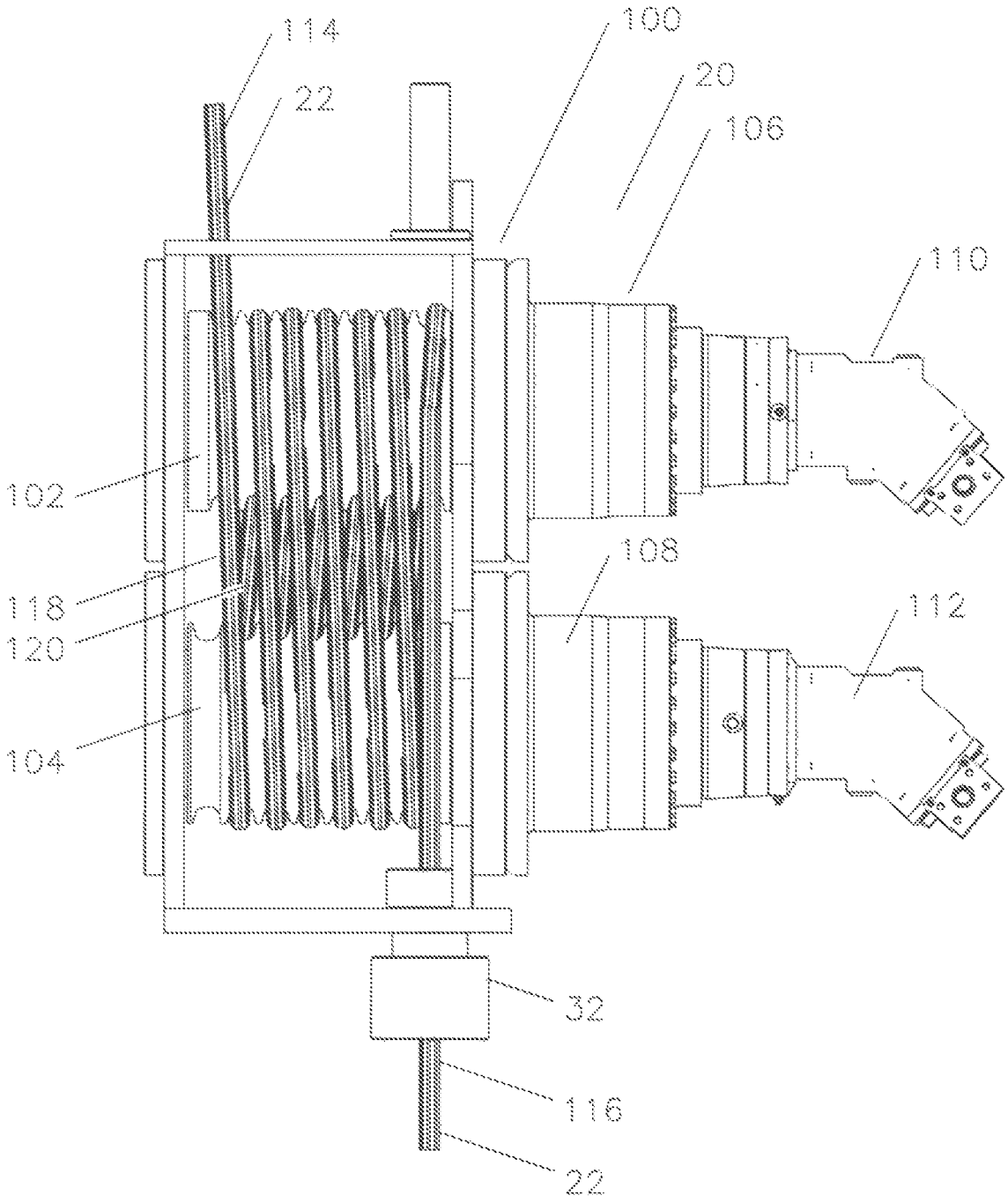
FIG. 6 is an internal view of a traction winch showing the parallel dual drums and a rope wrapped around the drums.

Referring now to FIG. 6, the inner workings 100 of a dual drum traction winch such as 20 are shown with dual grooved drums 102 and 104 powered by gear boxes 106 and 108 and motors 110 and 112. Synthetic rope 22 is shown entering the dual drum traction winch 20 at 114 (with some pretention) and exiting to the load at 116. Each of the drums 102 and 104 has seven grooves and synthetic rope 22 is shown going over the drums at 118 and coming back on the lower side at 120.

Figure 7:
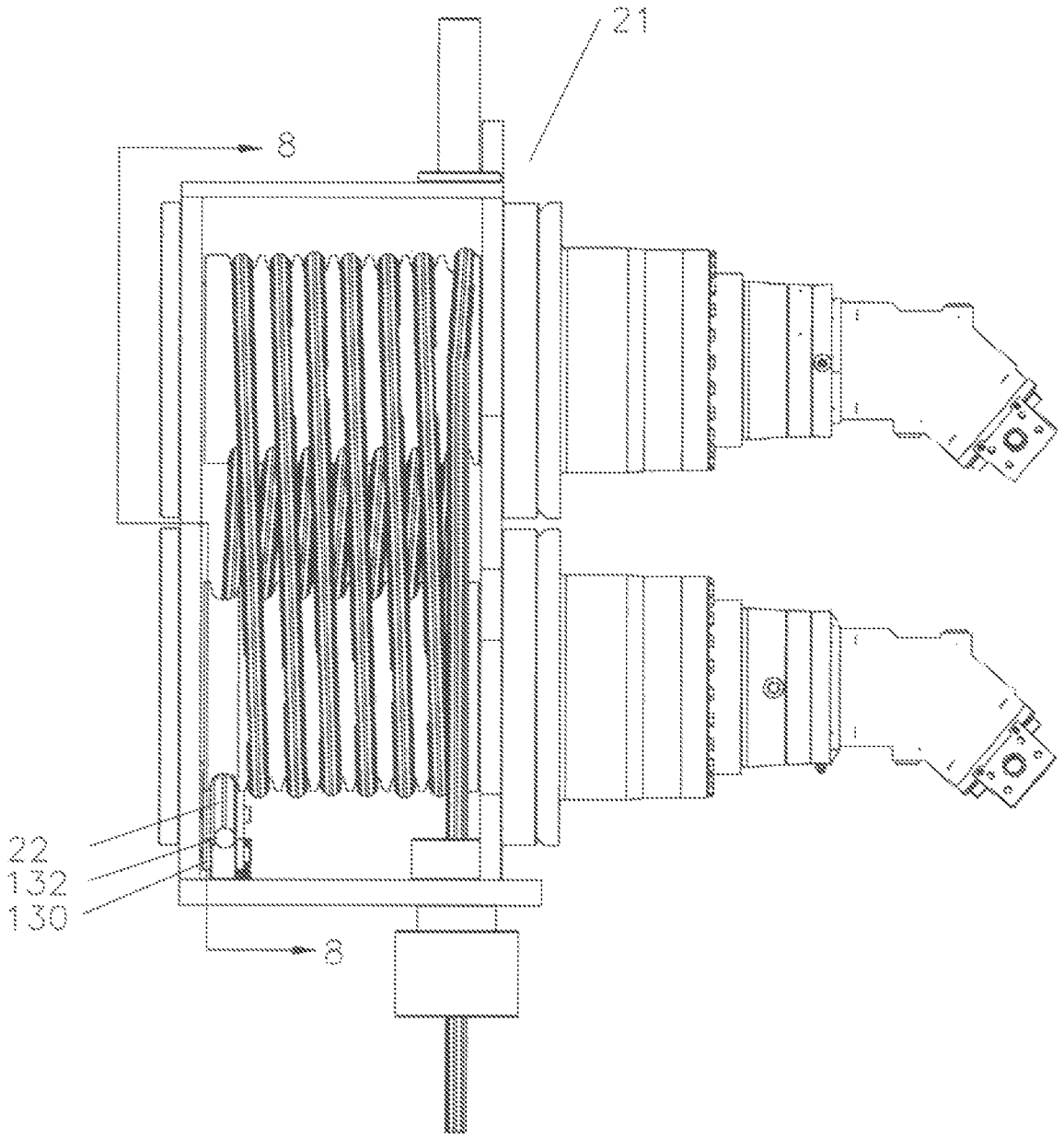
FIG. 7 is an internal view of a traction winch similar to FIG. 6 with a pretension device of the present invention added.

Referring now to FIG. 7, dual drum traction winch 21 is shown which is similar to FIG. 6 except for having a pretentions device 130 installed and the synthetic rope 22 exiting at 132.

Figure 8:
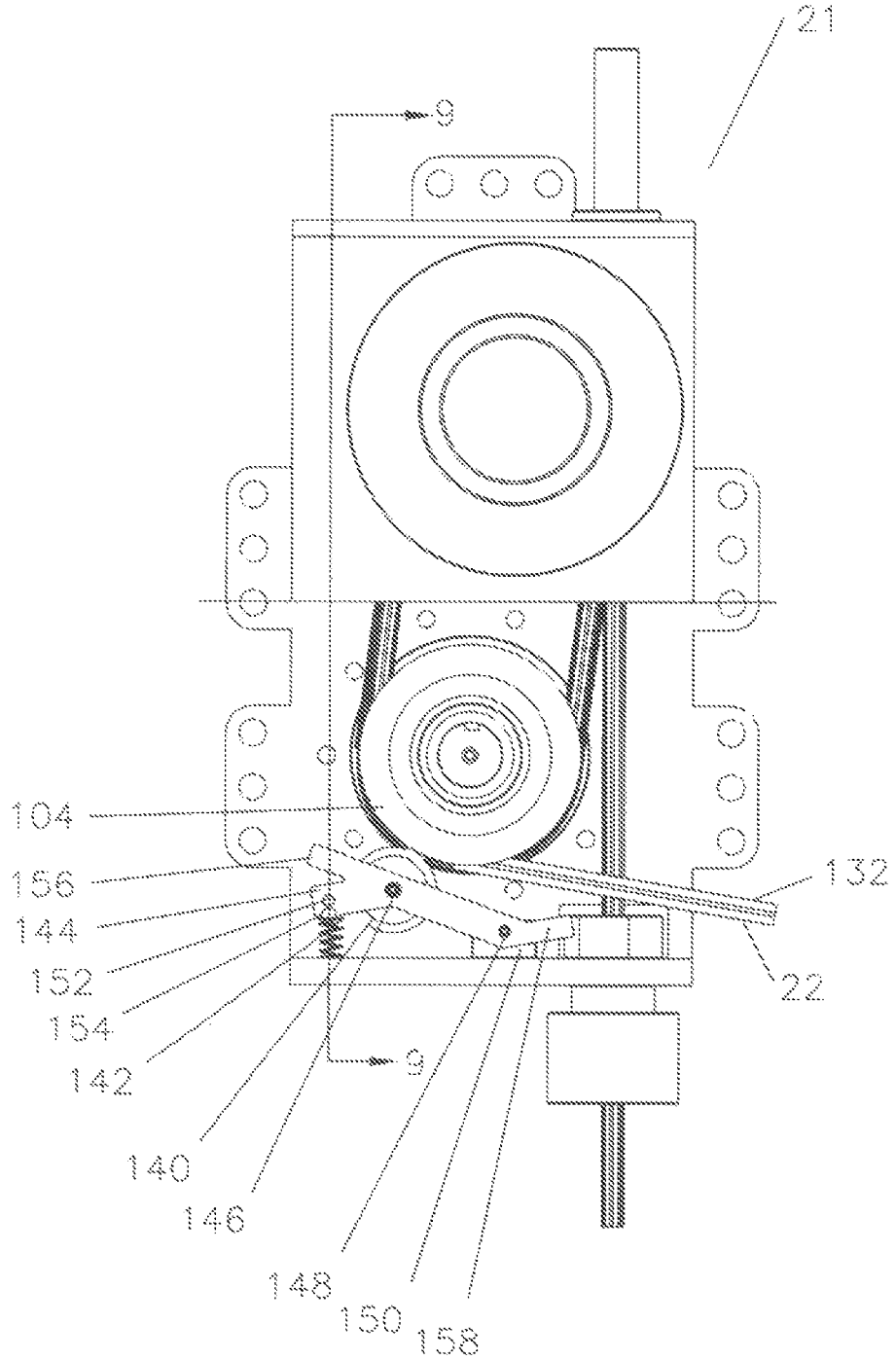
FIG. 8 is a partial section of a traction winch taken along lines "8-8" of FIG. 7 showing a better view of the pretension device.

Referring now to FIG. 8 which is taken along lines "8-8" of FIG. 7, pretention wheel 140 is loaded against drum 104 by spring 142 and is mounted in a pair of brackets 144 about axle 146. Brackets 144 are pivotably mounted about axle 148 on mounting block 150. Lockdown pin 152 is provided to retain the pretention wheel 140 in the disengaged position for loading the synthetic rope 22 into the dual drum traction winch 21 by engaging it into hole 154. Tangs 156 and 158 are provided for engagement with a pipe or similar tool to rotate brackets 144 against the spring 142 to engage lock-down pin 152 into hole 154.

Figure 9:
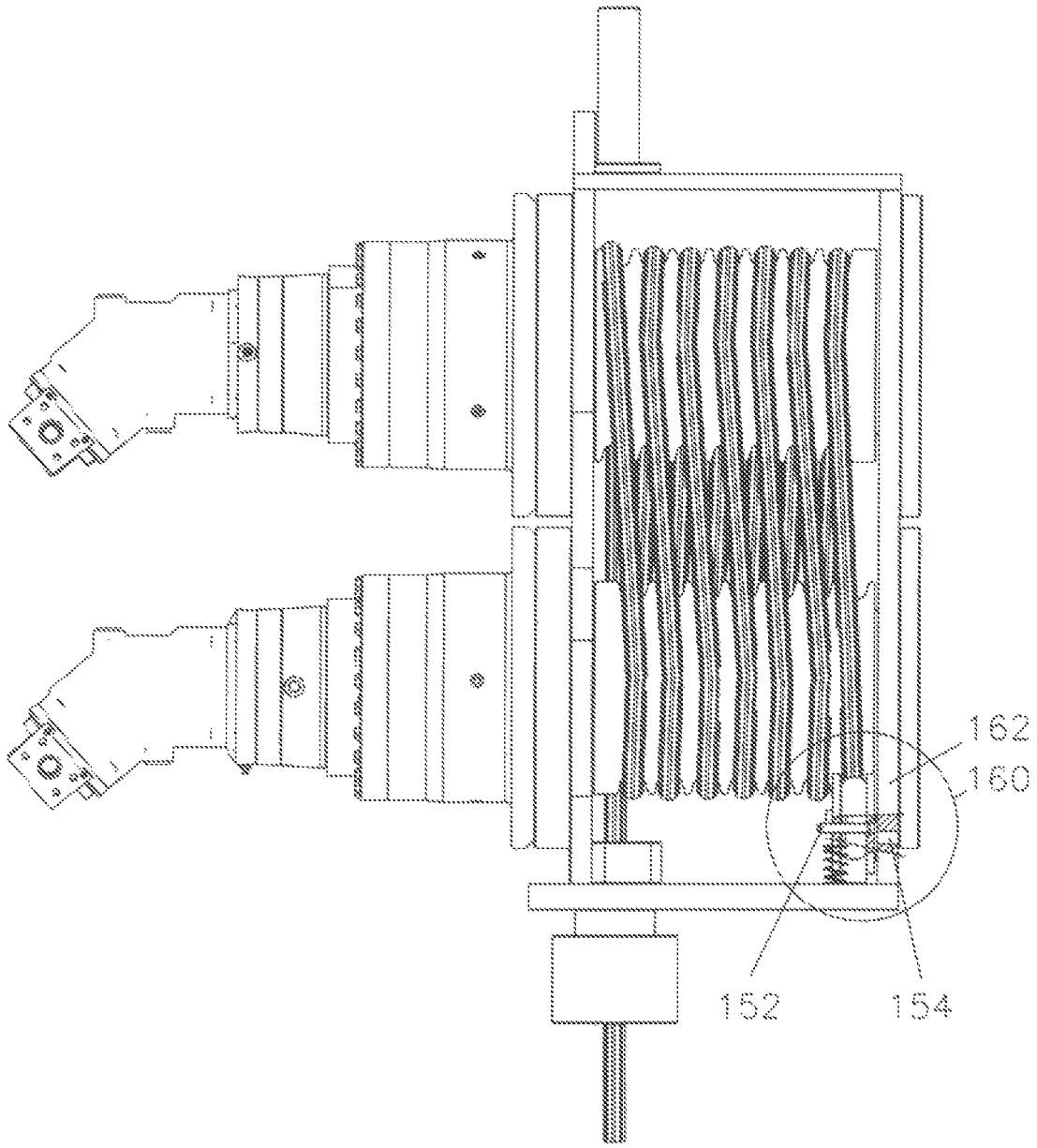
FIG. 9 is a section of a traction winch taken along lines "9-9" of FIG. 8.
Figure 10:
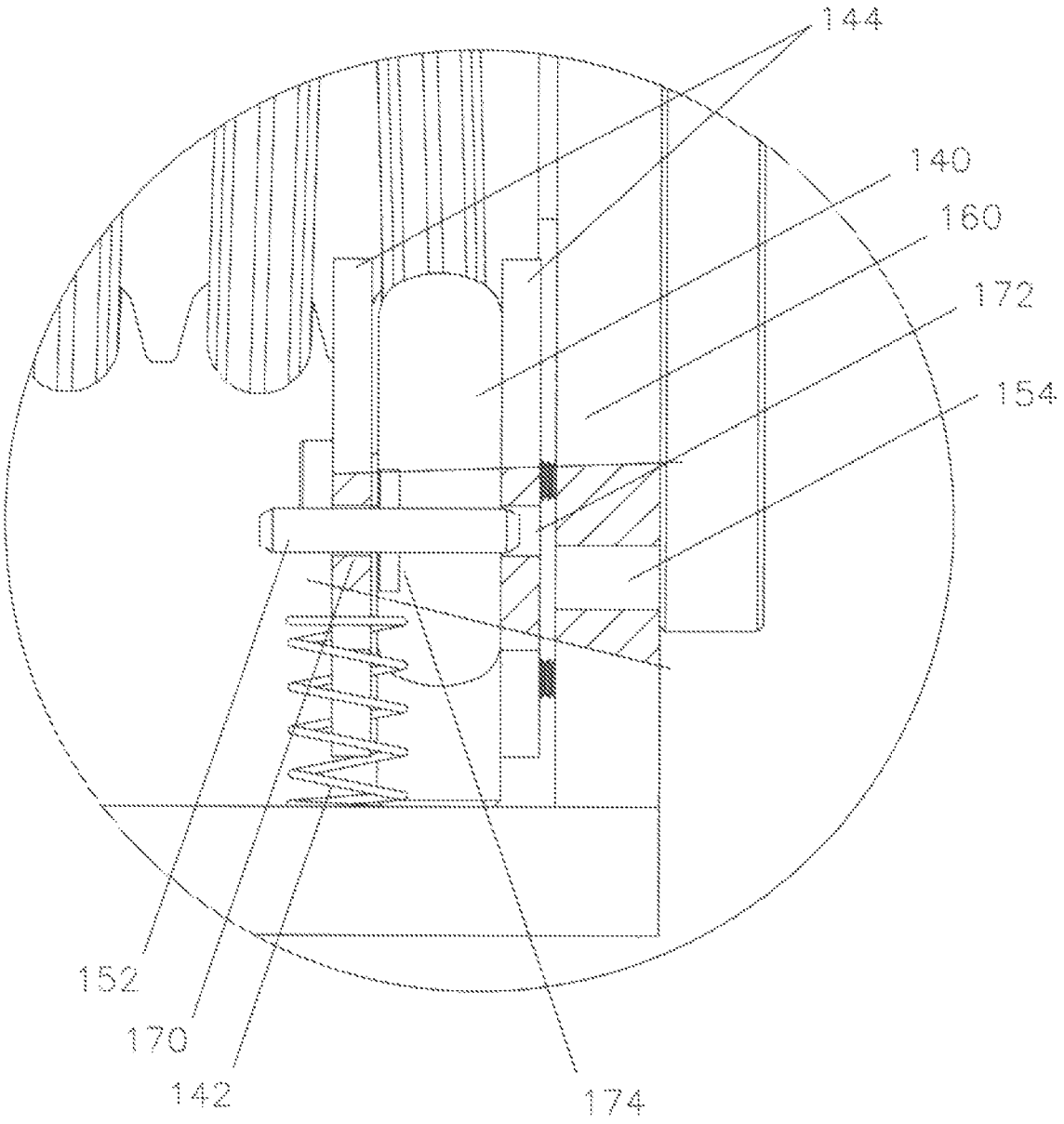
FIG. 10 is a partial section of a traction winch taken from the circle 160 of FIG. 9 showing more detail of the pretension device.

Referring now to FIG. 9 which is taken generally along lines "9-9" of FIG. 8, lockdown pin 152 is seen in a cutaway within circle 160, with hole 154 drilled in side plate 162, as will be seen in better detail in FIG. 10.

Referring now to FIG. 10, the area within circle 160 is expanded showing lockdown pin 152 in holes 170 and 172 of brackets 144. Pin 174 is provided in lockdown pin 152 such that when the brackets 144 are rotated downwardly, it can be used to move lockdown pin 152 into hole 154 and retain the brackets 144 in the disengaged position for loading the synthetic rope 22 in to the winch 21.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

SEQUENCE LISTING

N/A

That which is claimed is:

1. A method of providing pretention for a cable or rope on a dual drum traction winch comprising providing one or more rollers which can engage said cable or rope and press said cable or rope against one or more of said dual drums to cause a frictional load against said drum further comprising said one or more rollers is spring loaded against said cable or rope.

2. The method of claim 1 further comprising unloading said spring load to allow installation of said cable or rope onto said one or more of said dual drums.

3. The method of claim 2 further comprising locking said one or more rollers in the unloaded position.

4. The method of claim 3 further comprising locking said one or more rollers in said unloaded position by engaging a pin in a hole.

5. A method of providing pretention for a cable or rope on a dual drum traction winch comprising providing one or more rollers which can engage said cable or rope and press said cable or rope against one or more of said dual drums to cause a frictional load against said drum further comprising a mounting on said winch which allows said winch to be mounted in a rotatable style about said mounting.

6. The method of claim 5 further comprising a post on an opposite side of said winch from said mounting which is proximately coiinear with said mounting to support the distal side of said winch when said mounting places said winch in a proximately horizontal position.

7. A method of providing pretention for a cable or rope on a dual drum traction winch which can be used in any orientation comprising providing a mounting on said winch which allows said winch to be mounted in a rotatable style about said mounting, a post on an opposite side of said winch from said mounting which is proximately collinear with said mounting to support the distal side of said winch when said mounting places said winch in a proximately horizontal position, and one or more rollers which can engage said cable or rope and press said cable or rope against one or more of said dual drums to cause a frictional load against said drum to eliminate the need for pretention to be provided in the cable or rope approaching said winch.

8. The method of claim 7 further comprising said one or more rollers is spring loaded against said cable or rope.

9. The method of claim 8 further comprising unloading said spring load to allow installation of said cable or rope onto said one or more of said dual drums.

10. The method of claim 9 further comprising locking said one or more rollers in the unloaded position.

11. The method of claim 10 further comprising locking said one or more rollers in said unloaded position by engaging a pin in a hole.

* * * * *